US012383021B1

(12) United States Patent
Jayavel

(10) Patent No.: US 12,383,021 B1
(45) Date of Patent: Aug. 12, 2025

(54) SHOE SOLE AND METHODS OF MAKING SAME

(71) Applicant: Cole Haan LLC, Greenland, NH (US)

(72) Inventor: Narendran Jayavel, Hai Phong (VN)

(73) Assignee: COLE HAAN LLC, Greenland, NH (US)

( * ) Notice: Subject to any disclaimer, the term of this patent is extended or adjusted under 35 U.S.C. 154(b) by 0 days.

(21) Appl. No.: 18/940,412

(22) Filed: Nov. 7, 2024

(51) Int. Cl.
*A43B 13/02* (2022.01)
*A43D 8/16* (2006.01)

(52) U.S. Cl.
CPC ..... *A43B 13/02* (2013.01); *A43D 8/16* (2013.01)

(58) Field of Classification Search
CPC ..... A43B 13/02; A43D 8/16
See application file for complete search history.

(56) References Cited

U.S. PATENT DOCUMENTS

| | | | | |
|---|---|---|---|---|
| 2,161,083 | A * | 6/1939 | Owen | A43B 23/16 524/274 |
| 2012/0324619 | A1* | 12/2012 | Drago | A43B 3/0084 428/199 |
| 2016/0128433 | A1* | 5/2016 | Downing | A43D 8/16 264/400 |
| 2017/0027277 | A1* | 2/2017 | Anthony | A43B 7/1463 |
| 2018/0242694 | A1* | 8/2018 | Webster | B32B 5/024 |
| 2018/0289098 | A1* | 10/2018 | Downing | B23K 26/364 |
| 2020/0346485 | A1* | 11/2020 | Briner | A43B 3/0078 |

* cited by examiner

*Primary Examiner* — Bao-Thieu L Nguyen
(74) *Attorney, Agent, or Firm* — Thompson Coburn LLP

(57) ABSTRACT

A method of forming a shoe sole having the appearance of leather. A masking is applied to a peripheral margin of a shoe sole. After applying the masking to the peripheral margin, a first paint is applied to the sole edge. The first paint is of a first color. After applying the first paint, a second paint is applied to the sole edge. The second paint is of a second color. After applying the second paint, a third paint is applied to the sole edge to form a sole edge pattern. The third paint is of a third color different from the first and second colors. After applying the third paint, a lacquer finish is applied to the sole edge. The sole edge pattern has the appearance of leather.

24 Claims, 7 Drawing Sheets

SHOE SOLE AND METHODS OF MAKING SAME

CROSS-REFERENCE TO RELATED APPLICATIONS

Not Applicable.

STATEMENT REGARDING FEDERALLY SPONSORED RESEARCH OR DEVELOPMENT

Not Applicable.

APPENDIX

Not Applicable.

BACKGROUND OF THE INVENTION

Field of the Invention

This invention pertains to a shoe sole and methods of making the same.

SUMMARY

One aspect of the disclosure is a method of forming a shoe sole having the appearance of leather. A masking is applied to a peripheral margin of a shoe sole. The shoe sole is of a polymer material. The shoe sole has a sole top surface, a sole bottom surface, and a sole edge extending between the sole top surface and the sole bottom surface around a periphery of the sole. The peripheral margin extends at least partially around the periphery of the sole bottom surface. After applying the masking to the peripheral margin, a first paint is applied to the sole edge. The first paint is of a first color. After applying the first paint, a second paint is applied to the sole edge. The second paint is of a second color. After applying the second paint, a third paint is applied to the sole edge to form a sole edge pattern. The third paint is of a third color different from the first and second colors. After applying the third paint, a lacquer finish is applied to the sole edge. The sole edge pattern has the appearance of leather.

Another aspect of the disclosure is a method of forming a shoe sole having the appearance of leather. A first paint to a sole edge of a shoe sole. The first paint is of a first color. The shoe sole is of a polymer material. The shoe sole has a sole top surface, a sole bottom surface, the sole edge extending between the sole top surface and the sole bottom surface around a periphery of the sole. After applying the first paint, a second paint is applied to the sole edge via a roller printing process to form a sole edge pattern. The second paint is of a second color different from the first color. The roller printing process applies the second paint in a non-uniform coat such that the sole edge pattern has the appearance of leather. After the roller printing process, a lacquer finish is applied to the sole edge.

Yet another aspect of the disclosure is a shoe having a polymer sole member and an upper secured to the polymer sole member. The polymer sole member has a medial side and a lateral side. The polymer sole member extends between the medial side and the lateral side. The polymer sole member also has a heel end, a toe end, a heel region, a midfoot region, a forefoot region, and a toe region. The heel region extends from the heel end to the midfoot region. The midfoot region extends from the heel region to the forefoot region. The forefoot region extends from the midfoot region to the toe region. The toe region extends from the forefoot region to the toe end. The polymer sole member has a top surface, a bottom surface, and a sole edge that extends between the sole top surface and the sole bottom surface around a periphery of the polymer sole member. The polymer sole member has at least two grooves extending around the entire heel region periphery. The shoe further comprises a first paint having a first color and a second paint having a second color different from the first color. The periphery of the polymer sole member is covered by the first paint. The second paint is on the first paint in a stippled manner such that at least portions of the first paint is visible between the stippling of the second paint.

Further features and advantages, as well as the operation, are described in detail below with reference to the accompanying drawings.

Figure 1A:
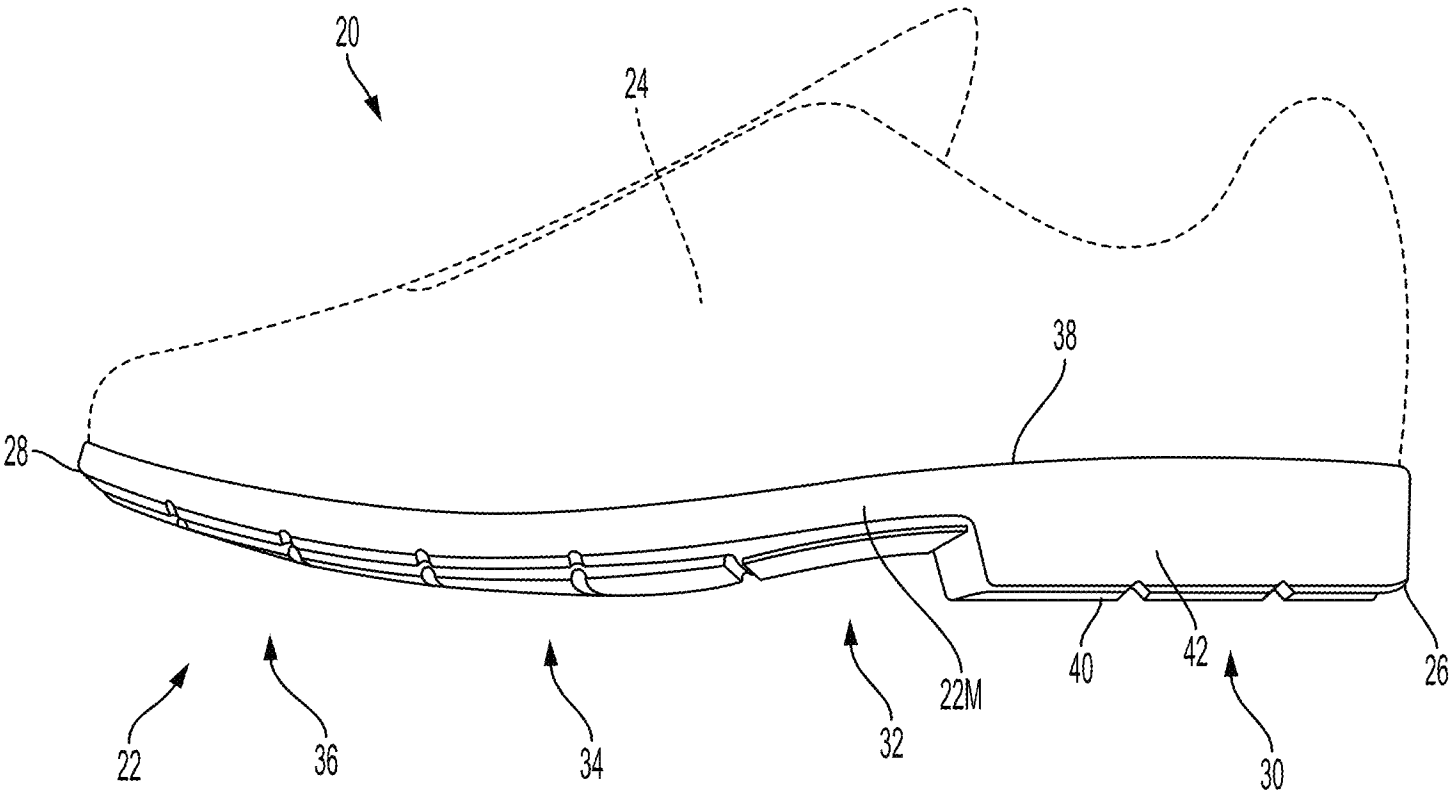
FIG. 1*a* is a medial side view of a shoe.

Reference numerals in the written specification and in the figures indicate corresponding items.

DETAILED DESCRIPTION

Figure 1B:
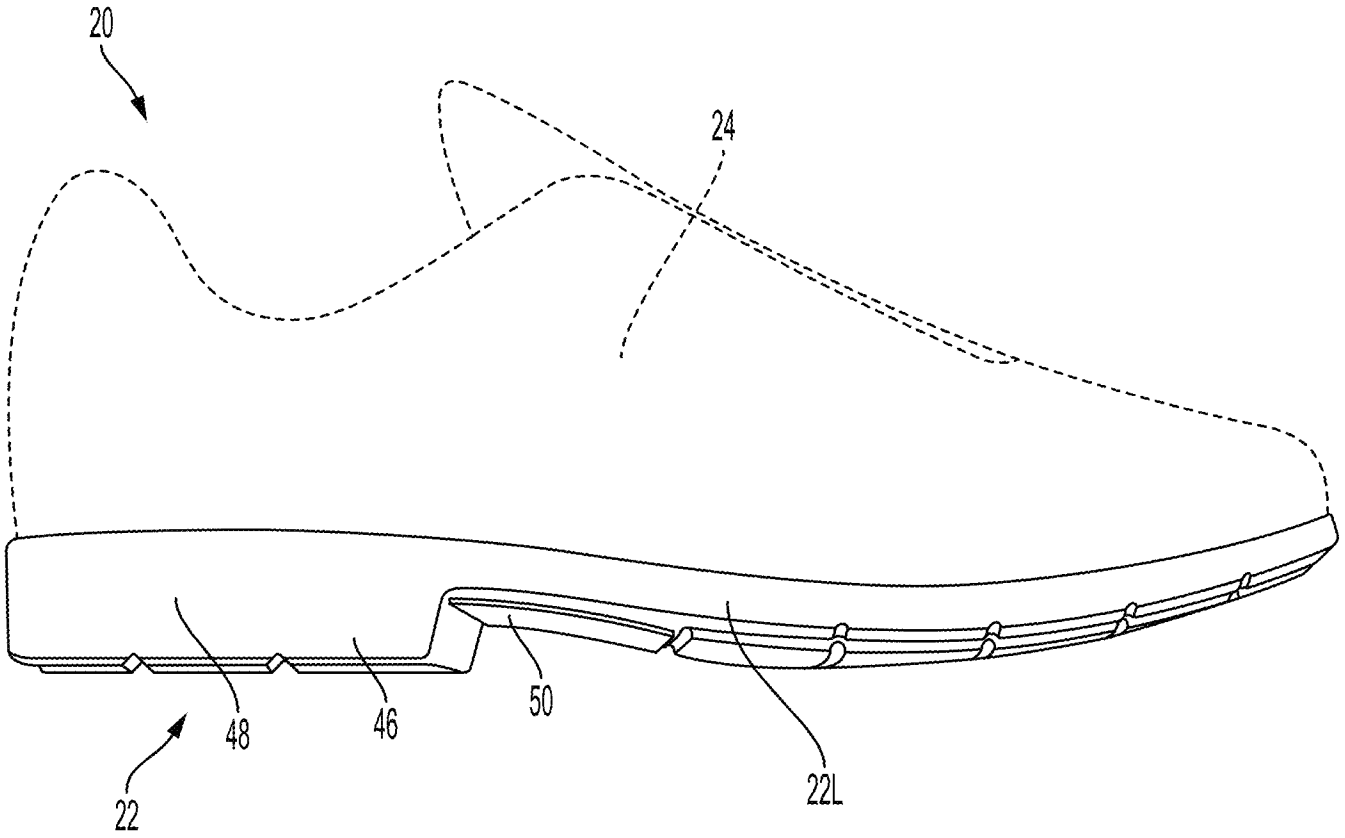
FIG. 1*b* is a lateral side view of the shoe of FIG. 1*a*.
Figure 1C:
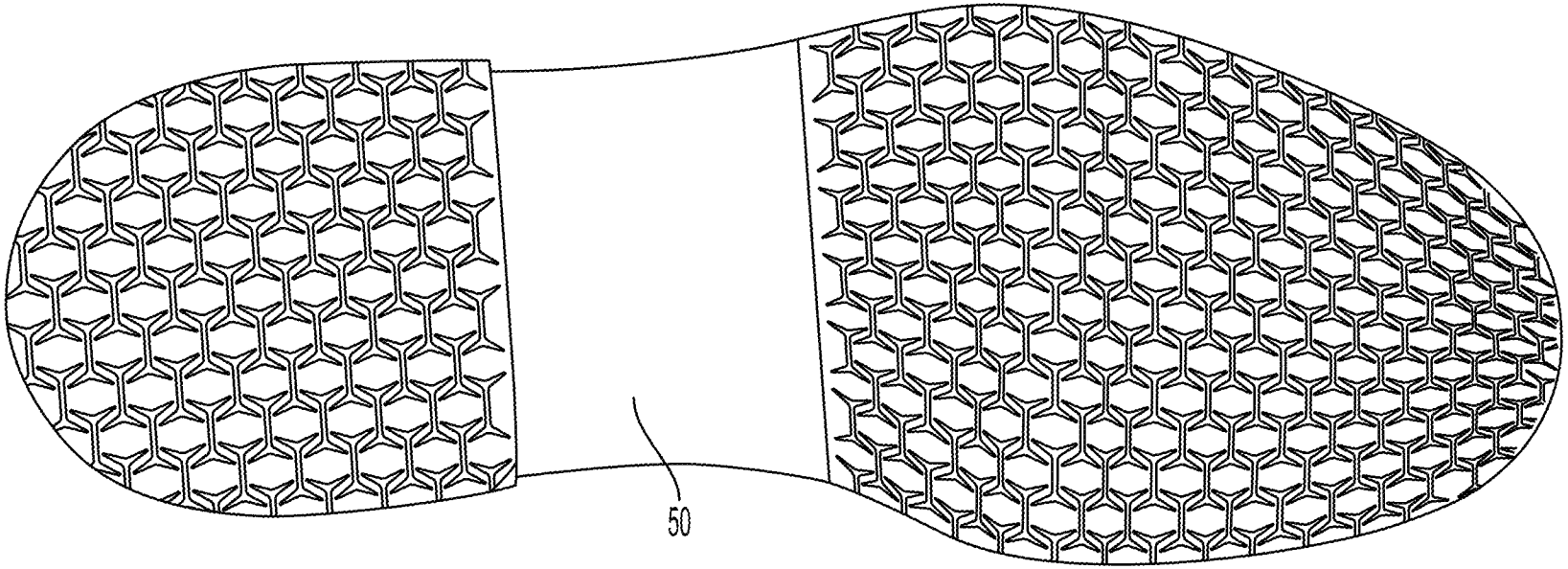
FIG. 1*c* is a bottom view of the shoe of FIG. 1*a*.

An embodiment of shoe in accordance with the present invention is indicated generally by reference number 20 in FIGS. 1*a*-1*c*. The shoe 20 has a polymer sole member 22 and an upper 24 secured to the polymer sole member. The polymer sole member 22 has a medial side 22M and a lateral side 22L. The polymer sole member 22 extends between the medial side 22M and the lateral side 22L. The polymer sole member also has a heel end 26, a toe end 28, a heel region 30, a midfoot region 32, a forefoot region 34, and a toe region 36. The heel region 30 extends from the heel end 26 to the midfoot region 32. The midfoot region 32 extends from the heel region 30 to the forefoot region 34. The forefoot region 34 extends from the midfoot region 32 to the toe region 36. The toe region 36 extends from the forefoot region 34 to the toe end 28.

The polymer sole member has a top surface 38, a bottom surface 40, and a sole edge 42 extending between the sole top surface and the sole bottom surface around a periphery of the polymer sole member 22.

The shoe further comprises a first paint 46 having a first color and a second paint 48 having a second color different from the first color. The periphery 42 of the polymer sole member is covered by the first paint 46. The second paint 48 is on the first paint 46 in a stippled manner such that at least portions of the first paint is visible between the stippling of the second paint.

The shoe 20 may further comprise a leather sole member 50. The leather sole member 50 is operatively connected to the sole bottom surface 40 in the midfoot region 32. The leather sole member may be embossed, branded, or gilded with a design (now shown).

The polymer sole member 22 may comprise a first sole component 22*a* and a second sole component 22*b*. The first sole component 22*a* may circumscribe the second sole component 22*b*. The first sole component 22*a* may have a hardness of 60-65 Asker C and the second sole component 22*b* may have a hardness of 50-55 Asker C. One or both of the first and second sole components 22*a*, 22*b* may comprise ethylene vinyl acetate (EVA), thermoplastic polyurethane (TPU), or the like.

Figure 2A:
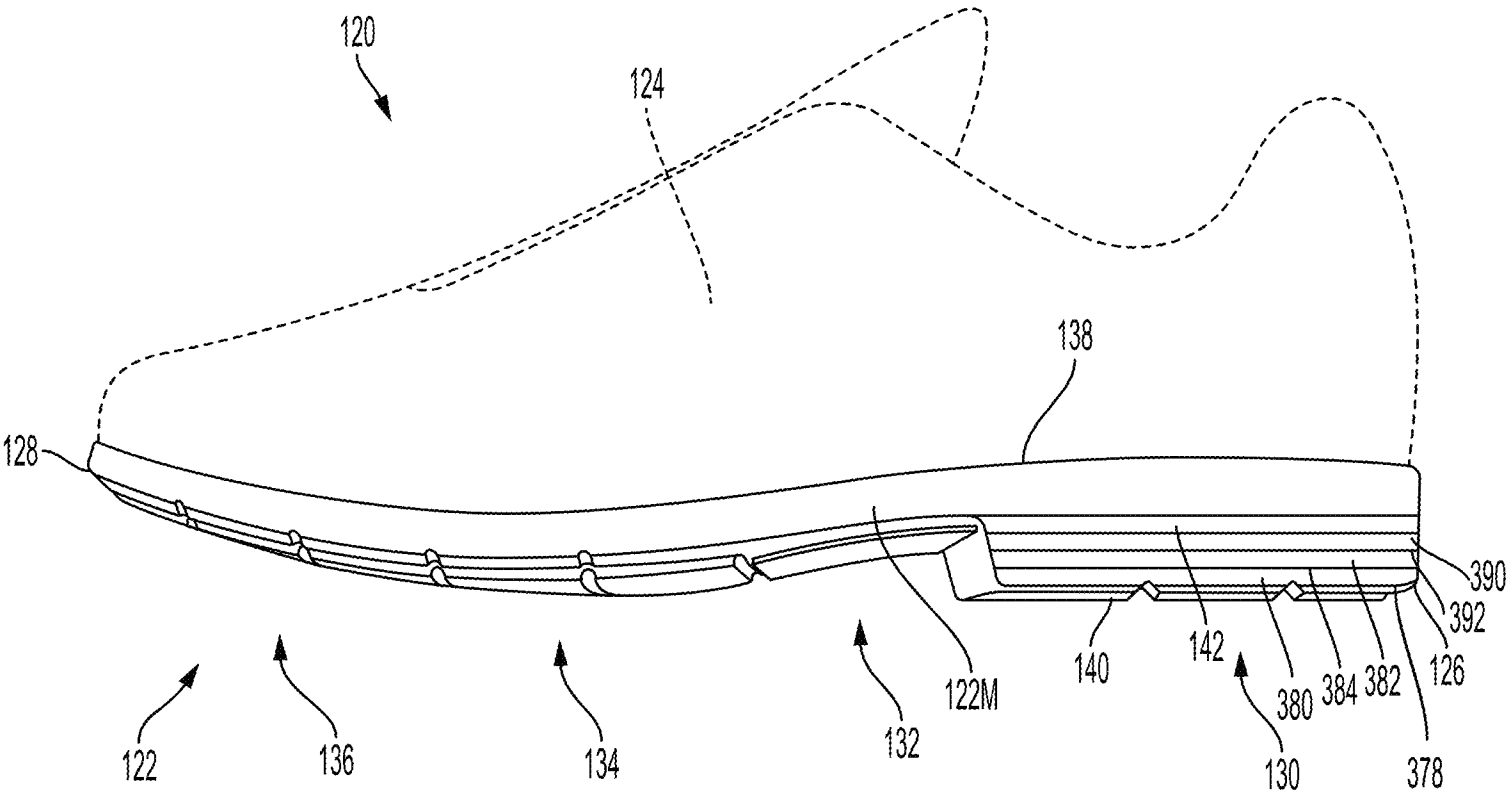
FIG. 2*a* is a medial side view of another embodiment of a shoe.
Figure 2B:
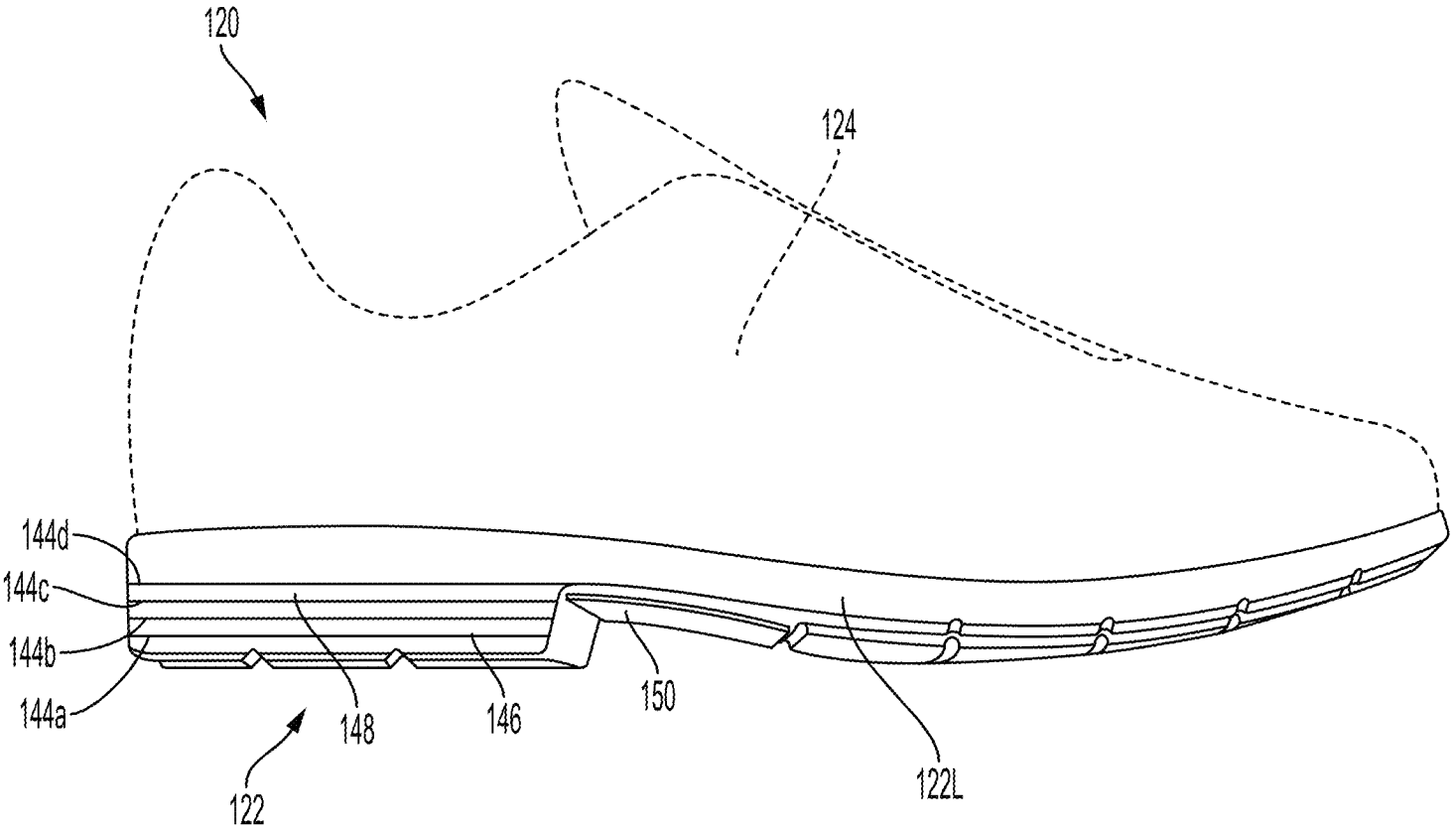
FIG. 2*b* is a lateral side view of the shoe of FIG. 2*a*.

FIGS. 2*a* and 2*b* show another embodiment of shoe 120. The shoe 120 may be similar in all respects to the shoe 20, except as noted herein. It is also to be understood that components, elements, features, or regions of the embodiment of FIGS. 2*a* and 2*b* have reference numbers corresponding to the reference numbers of the embodiment of FIGS. 1*a*-1*c*, except the reference numbers of the embodiment of FIGS. 2*a* and 2*b* includes a prefix "1."

The polymer sole member 122 may have at least two grooves 144 extending around the entire heel region periphery. The at least two grooves 144 may comprise a first groove 144*a* and a second groove 144*b*. The first and second grooves 144*a*, 144*b* may extend around a majority of the periphery 142 of the sole 122. The at least two grooves 144 may further comprise a third groove 144*c* and a fourth groove 144*d*. The third and fourth grooves may extend around a majority of the periphery 142 of the sole 122.

Figure 3:
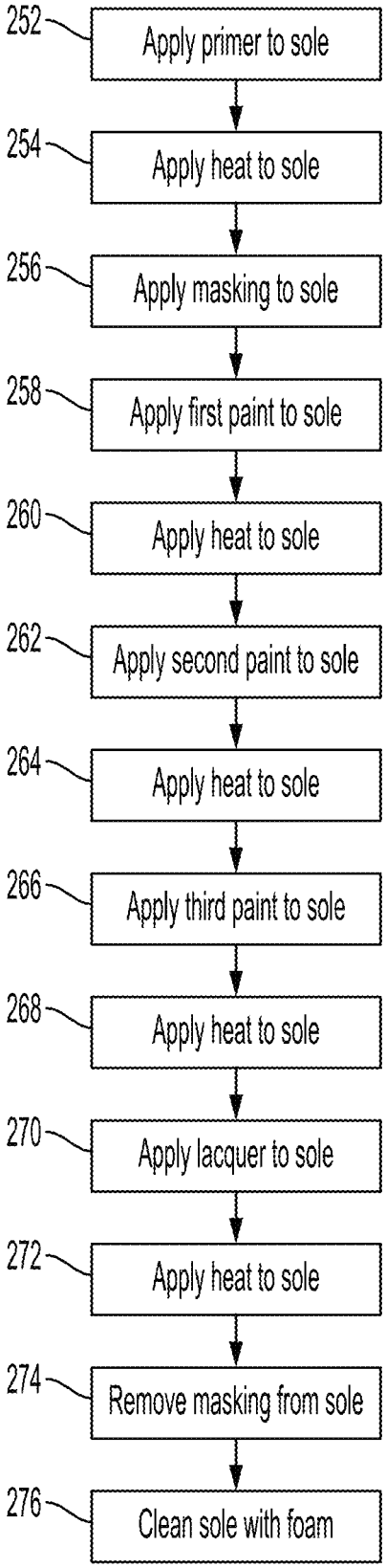
FIG. 3 is a flow diagram for a method of manufacturing the sole of the shoe of FIGS. 1*a* and/or 2*a*.

FIG. 3 is a flow diagram of an embodiment of a method of manufacturing the shoe sole 22 and/or the shoe sole 122.

Referring to reference number 256, the method comprises applying a masking to a peripheral margin of a shoe sole. The peripheral margin extends at least partially around the periphery of the sole bottom surface.

Referring to reference number 258, the method further comprises, after applying the masking to the peripheral margin, applying a first paint to the sole edge. The first paint is of a first color. The first paint may be a solvent-based adhesive (e.g., TPU base ink/Solvent-Based TPU-500).

Referring to reference number 262, the method further comprises, after applying the first paint, applying a second paint to the sole edge. The second paint is of a second color. The second paint may be a solvent-based adhesive (e.g., TPU base ink/Solvent-Based TPU-500). The second paint may be different from the first paint and, likewise, may have a different color from the first paint. Alternatively, the second paint may be the same as the first paint and have the same color as the first paint. In the latter scenario, the first paint constitutes a first coat of the first paint and the second paint constitutes a second coat of the first paint.

Referring to reference number 266, the method further comprises, after applying the second paint, applying a third paint to the sole edge to form a sole edge pattern. The third paint is of a third color different from the first and second colors. The third paint may be applied via a roller printing process.

Referring to reference number 270, the method further comprises, after applying the third paint, applying a lacquer finish to the sole edge.

The method may further comprise applying a primer to the sole edge. This is shown via reference number 252. The primer cleans the sole edge, creating a surface that is more suitable for the application of paint.

Referring to reference number 274, the method may further comprise removing the masking after the lacquer finish is applied.

Referring to reference number 276, the method may further comprise cleaning the shoe sole with foam after the masking is removed.

The method may further comprise applying heat to the shoe sole. This may occur at any of the following: (1) after applying the primer but before the applying the masking to the peripheral margin (reference number 254); (2) after applying the first paint but before applying the second paint (reference number 260); (3) after applying the second paint but before applying the third paint (reference number 264); after applying the third paint but before applying the lacquer finish (reference number (268); and/or after the lacquer finish is applied but before the masking is removed (reference number 272). Preferably, each instance in which heat is applied to the shoe sole may occur in a heating chamber having a heating chamber temperature between 40 and 50 degrees Celsius, inclusive. More preferably, the heating chamber temperature is 44 degrees Celsius. Preferably, each instance in which heat is applied to the shoe sole comprises applying heat in the heating chamber for 10±5 minutes. More preferably, each instance in which heat is applied to the shoe sole comprises applying heat in the heating chamber for 5 minutes. Each instance in which heating applies facilitates the rapid drying of the material applied in the immediately prior step (e.g., primer, first paint, second paint, third paint, or lacquer). Similar results may be achieved by allowing the primer, first paint, second paint, third paint, or lacquer to dry naturally, but the process may take substantially longer depending on drying conditions (e.g., humidity, airflow, temperature, etc.).

The sole edge pattern resulting from the method of the present embodiment has the appearance of leather. In other words, it resembles a stacked leather sole. As used herein, a stacked leather sole refers to a sole comprising multiple pieces of leather stacked one upon another (joined by adhesive and/or fastening components such as nails) to form a unitary sole. Often, the stacked leather sole is also abraded (e.g., sanded or burnished) to make the individual leathers of layer be of a uniform dimension such that they appear to be striations in a single component.

Figure 4:
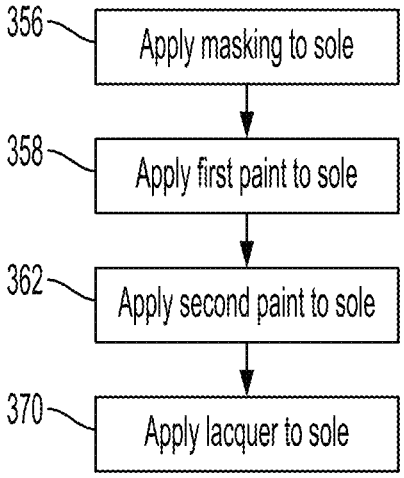
FIG. 4 is a flow diagram for a method of manufacturing the sole of the shoe of FIGS. 1*a* and/or 2*a*.

FIG. 4 is a flow diagram of another embodiment of a method of manufacturing the shoe sole 22 and/or 122.

Referring to reference number 358, the method comprises applying a first paint to a sole edge of a shoe sole. The first paint is of a first color. The sole edge 42/142 may comprise a first sole edge region 380, a second sole edge region 382, and a narrow first intermediate sole edge region 384. The first intermediate sole edge region 384 is between and adjacent the first and second sole edge regions 380, 382. The applying the first paint to the sole edge may comprise applying the first paint to each of the first sole edge region 380, the second sole edge region 382, and the first intermediate sole edge region 384. The first paint may be uniformly applied to the first, second, and intermediate regions 380, 382, 384 such that at least a portion of the first paint is visible in the first and second sole edge regions after the second paint is applied.

Referring to reference number 362, the method further comprises, after applying the first paint, applying a second paint to the sole edge via a roller printing process to form a sole edge pattern. The second paint is of a second color different from the first color. The roller printing process applies the second paint in a non-uniform coat such that the sole edge pattern has the appearance of leather. The applying the second paint to the sole edge via the roller printing process to form the sole edge pattern may first comprise applying the second paint to a rotatable roller (not shown). The roller may have a printing surface that has a first roller region having a first texture and a second roller region having a second texture. The first roller region may be spaced from the second roller region. Second, the sole edge 42/142 and the roller may be brought into contact with one another to transfer some of the second paint on the first roller region to the first sole edge region 380 in a stippled manner and to transfer some of the second paint on the second roller region to the second sole edge region 382 in a stippled manner. When so applied, the first intermediate sole edge region 384 is largely devoid of the second paint such that a narrow band of the first paint in the first intermediate sole edge region visibly demarcates the first sole edge region 380 from the second sole edge region 382.

The sole edge 42/142 may further comprise a third sole edge region 390 and a narrow second intermediate sole edge region 392. The second intermediate sole edge region 392 is between and adjacent the second and third sole edge regions 382, 390. The applying the first paint to the sole edge 42/142 may further comprise applying the first paint to each of the third sole edge region 390 and the second intermediate sole edge region 392.

The applying the second paint to the sole edge 42/142 via the roller printing process to form the sole edge pattern may further comprise applying the second paint to a third roller region of the third roller. The third roller region may have a third texture. The third roller region may be spaced from the first and second roller regions. Likewise, bringing the sole edge 42/142 and the roller into contact with one another may transfer some of the second paint on the third roller region to the third sole edge region 390 in a stippled manner. The second intermediate sole edge region 392 is largely devoid of the second paint such that a narrow band of the first paint in the second intermediate sole edge region visibly demarcates the second sole edge region 382 from the third sole edge region 390.

As noted above, the sole may have first and second grooves 144*a*, 144*b*. In such a case, bringing the sole edge 42/142 and the roller into contact with one another may comprise aligning the first groove such that it is between the first and second roller regions and aligning the second groove such that it is between the second and third roller regions such that, after the second paint is applied, the first intermediate sole edge region 384 includes the first groove and the second intermediate sole edge region 392 includes the second groove.

Referring to reference number 370, the method further comprises, after the roller printing process, applying a lacquer finish to the sole edge.

The method may further comprise applying a masking (reference number 356). The applying the masking occurs before the first paint is applied. The applying the masking may comprise applying the masking to a peripheral margin of the sole bottom surface. The peripheral margin extending at least partially around the periphery of the sole bottom surface. The heel region 30/130 may have a heel region margin 378. The heel region margin 378 is the portion of the sole edge 42/142 in the heel region 30/130 adjacent the sole bottom surface 40/140. The applying the masking may comprises applying the masking to the heel region margin.

In view of the foregoing, it should be appreciated that the invention has several advantages over the prior art.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A method of forming a shoe sole having the appearance of leather, the method comprising:

applying a primer to the sole edge;

after applying the primer, applying heat to the shoe sole;

after applying heat to the shoe sole, applying a masking to a peripheral margin of a shoe sole, the shoe sole being of a polymer material, the shoe sole having a sole top surface, a sole bottom surface, and a sole edge extending between the sole top surface and the sole bottom surface around a periphery of the sole, the peripheral margin extending at least partially around the periphery of the sole bottom surface;

after applying the masking to the peripheral margin, applying a first paint to the sole edge, the first paint being of a first color;

after applying the first paint, applying a second paint to the sole edge, the second paint being of a second color;

after applying the second paint, applying a third paint to the sole edge to form a sole edge pattern, the third paint being of a third color different from the first and second colors;

after applying the third paint, applying a lacquer finish to the sole edge; and wherein the sole edge pattern has the appearance of leather.

2. The method of claim 1 further comprising applying heat to the shoe sole after applying the first paint but before applying the second paint.

3. The method of claim 2 further comprising applying heat to the shoe sole after applying the second paint but before applying the third paint.

4. The method of claim 3 further comprising applying heat to the shoe sole after applying the third paint but before applying the lacquer finish.

5. The method of claim 4 further comprising removing the masking after the lacquer finish is applied.

6. The method of claim 5 further comprising applying heat to the shoe sole after the lacquer finish is applied but before the masking is removed.

7. The method of claim 6 further comprising cleaning the shoe sole with foam, the cleaning the shoe sole occurring after removing the masking.

8. The method of claim 6 wherein each instance of applying heat to the shoe sole comprises occurs in a heating chamber having a heating chamber temperature, the heating chamber temperature being between 40 and 50 degrees Celsius, inclusive.

9. The method of claim 8 wherein the heating chamber temperature is 44 degrees Celsius.

10. The method of claim 8 wherein each instance of applying heat to the shoe sole comprises applying heat in the heating chamber for 10±5 minutes.

11. The method of claim 1 wherein the sole edge pattern has the appearance of stacked leather.

12. The method of claim 1 wherein the third paint is applied via a roller printing process.

13. The method of claim 12 wherein the first color is different from the second color.

14. The method of claim 12 wherein the first color is the same as the second color.

15. The method of claim 1 wherein the shoe sole comprises a first sole component and a second sole component, the first sole component circumscribing the second sole component.

16. The method of claim 15 wherein the first sole component has a hardness of 60-65 Asker C.

17. The method of claim 16 wherein the second sole component has a hardness of 50-55 Asker C.

18. The method of claim 17 wherein at least one of the first and second sole components comprises ethylene vinyl acetate (EVA).

19. A method of forming a shoe sole having the appearance of leather, the method comprising:

applying a first paint to a sole edge of a shoe sole, the first paint being of a first color, the shoe sole being of a polymer material, the shoe sole having a sole top surface, a sole bottom surface, the sole edge extending between the sole top surface and the sole bottom surface around a periphery of the sole;

after applying the first paint, applying a second paint to the sole edge via a roller printing process to form a sole edge pattern, the second paint being of a second color different from the first color, the roller printing process applying the second paint in a non-uniform coat such that the sole edge pattern has the appearance of leather;

after the roller printing process, applying a lacquer finish to the sole edge;

wherein the sole edge comprises a first sole edge region, a second sole edge region, and a narrow first intermediate sole edge region, the first intermediate sole edge region being between and adjacent the first and second sole edge regions, the applying the first paint to the sole edge comprising applying the first paint to each of the first sole edge region, the second sole edge region, and the first intermediate sole edge region, and wherein the applying the second paint to the sole edge via the roller printing process to form the sole edge pattern comprises:

applying the second paint to a rotatable roller, the roller having a printing surface, the printing surface having a first roller region having a first texture and a second roller region having a second texture, the first roller region being spaced from the second roller region;

bringing the sole edge and the roller into contact with one another to transfer some of the second paint on the first roller region to the first sole edge region in a stippled manner and to transfer some of the second paint on the second roller region to the second sole edge region in a stippled manner, the first intermediate sole edge region being largely devoid of the second paint such that a narrow band of the first paint in the first intermediate sole edge region visibly demarcates the first sole edge region from the second sole edge region.

20. The method of claim 19 further comprising applying a masking, the applying the masking occurring before the first paint is applied, and wherein the applying the masking comprises applying the masking to a peripheral margin of the sole bottom surface, the peripheral margin extending at least partially around the periphery of the sole bottom surface.

21. The method of claim 20 wherein the shoe sole has a heel end, a toe end, a heel region, a midfoot region, a forefoot region, and a toe region, the heel region extending from the heel end to the midfoot region, the midfoot region extending from the heel region to the forefoot region, the forefoot region extending from the midfoot region to the toe region, the toe region extending from the forefoot region to the toe end, the heel region having a heel region margin, the heel region margin being the portion of the sole edge in the heel region adjacent the sole bottom surface, and wherein the applying the masking further comprises applying the masking to the heel region margin.

22. The method of claim 19 further comprising applying a masking before the first paint is applied, wherein the shoe sole has a heel end, a toe end, a heel region, a midfoot region, a forefoot region, and a toe region, the heel region extending from the heel end to the midfoot region, the midfoot region extending from the heel region to the forefoot region, the forefoot region extending from the midfoot region to the toe region, the toe region extending from the forefoot region to the toe end, the heel region having a heel region margin, the heel region margin being the portion of the sole edge in the heel region adjacent the sole bottom surface, and wherein the applying the masking comprises applying the masking to the heel region margin.

23. The method of claim 19 wherein the applying the first paint to the sole edge comprises uniformly applying the first paint to the first, second, and third sole edge regions such that at least a portion of the first paint is visible in the first and second sole edge regions after the applying the second paint.

24. The method of claim 19 wherein the sole edge further comprises a third sole edge region and a narrow second intermediate sole edge region, the second intermediate sole edge region being between and adjacent the second and third sole edge regions, the applying the first paint to the sole edge further comprising applying the first paint to each of the third sole edge region and the second intermediate sole edge region, and wherein the applying the second paint to the sole edge via the roller printing process to form the sole edge pattern further comprises:

applying the second paint to a rotatable roller, the roller having a printing surface having a third roller region having a third texture, the third roller region being spaced from the first and second roller regions;

bringing the sole edge and the roller into contact with one another to transfer some of the second paint on the third roller region to the third sole edge region in a stippled manner, the second intermediate sole edge region being largely devoid of the second paint such that a narrow band of the first paint in the second intermediate sole edge region visibly demarcates the second sole edge region from the third sole edge region.

* * * * *